United States Patent [19]

Ogaki et al.

[11] 4,145,155

[45] Mar. 20, 1979

[54] PAVING MATERIAL EXTRUSION MOLDING APPARATUS

[75] Inventors: Koji Ogaki, Yokohama; Katsu Hirosawa; Masashi Kaminishi, both of Hiratsuka; Yoshinori Nozawa, Tokyo; Hiroshi Kakuta, Isehara; Akio Aoki, Chigasaki, all of Japan

[73] Assignee: Kabushiki Kaisha Komatsu Seisakusho, Tokyo, Japan

[21] Appl. No.: 823,880

[22] Filed: Aug. 11, 1977

[30] Foreign Application Priority Data

Aug. 13, 1976 [JP] Japan ..... 51-107541
Aug. 13, 1976 [JP] Japan ..... 51-96140
Aug. 13, 1976 [JP] Japan ..... 51-96141

[51] Int. Cl.[2] ..... E01C 11/28
[52] U.S. Cl. ..... 404/98; 404/104
[58] Field of Search ..... 404/98, 96, 95, 118, 404/101, 105, 110, 104

[56] References Cited

U.S. PATENT DOCUMENTS

| | | | |
|---|---|---|---|
| 2,818,790 | 1/1958 | Canfield | 404/98 |
| 3,137,220 | 6/1964 | Smith | 404/98 |
| 3,161,117 | 12/1964 | Supject | 404/98 |
| 3,175,477 | 3/1965 | Cheney | 404/84 |
| 3,280,711 | 10/1966 | Jennings | 404/98 |
| 3,292,511 | 12/1966 | Cheney | 404/98 X |
| 3,363,523 | 1/1968 | Brock | 404/95 |
| 3,605,580 | 9/1971 | Miller | 404/98 |
| 3,606,827 | 9/1971 | Miller | 404/98 |
| 3,733,140 | 5/1973 | James | 404/98 |
| 3,920,349 | 11/1975 | Jennings | 404/98 |
| 4,067,676 | 1/1978 | Hewitt | 404/100 X |

*Primary Examiner*—Nile C. Byers, Jr.
*Attorney, Agent, or Firm*—Armstrong, Nikaido, Marmelstein & Kubovcik

[57] ABSTRACT

The paving material supplied into a hopper is conveyed by screw conveyors into a mold provided in the lower part of the apparatus thereby molding and laying the material. The paving material is densely compacted or consolidated in the mold, and when the paving material is conveyed under pressure further, the mold can be pushed up, and the reaction force of the conveying pressure acts to move the entire apparatus horizontally. Thus, structure having the same sectional shape as that of the mold can be formed and laid continuously on the ground.

11 Claims, 7 Drawing Figures

PAVING MATERIAL EXTRUSION MOLDING APPARATUS

BACKGROUND OF THE INVENTION

This invention relates to an improvement of the apparatus for automatically molding and laying a structure made from asphalt, cement, earth or sand or combination thereof or setting or thermoplastic materials as raw materials, and more particularly to an apparatus comprising a hopper means, screw conveyors and a mold, the arrangement being made such that the material supplied into the hopper means can be conveyed under pressure by the screw conveyors into the mold thereby laying the structure thus molded on the ground continuously.

There has been known and employed the apparatus in which paving material is dumped into a hopper and forced by screw conveyors into a mold part thereby automatically forming and laying curb-stones, gutter stones on roads and U-shaped gutters in safety zones of roads, the conveying pressure acting to move the apparatus itself.

However, the above-mentioned conventional apparatus is disadvantageous in that because a single screw conveyor is provided both for conveying or forcing paving material into the mold part and for moving the apparatus per se, the use of such apparatus has been limited to only the case when laying a structure of a small sectional area, and so when forming, for examples, channels or waterways having a large width, the paving material cannot be distributed uniformly by means of the single screw conveyor. Further, the above-mentioned conventional apparatus is disadvantageous in that when structural material having different properties such as cement and asphalt etc. are employed, the densities of the materials cannot be adjusted properly according to the characteristics thereof and therefore part of the structure formed thereby tends to be broken during and after the formation or molding.

SUMMARY OF THE INVENTION

The present invention has been contemplated for eliminating the disadvantages and difficulties of the above-mentioned conventional apparatus, and has for its principal object to provide an apparatus for automatically laying a channel or waterway.

Another object of the present invention is to provide an apparatus in which paving material can be conveyed under pressure by means of screw conveyors into a mold part, and the reaction force of the conveying pressure can be used to propell the apparatus while it is laying a channel or waterway.

A further object of the present invention is to provide an apparatus having a plurality of screw conveyors for laying a channel or waterway.

Another object of the present invention is to provide an apparatus for laying a channel wherein paving material can be uniformly conveyed into a mold thereby enabling a densely compacted channel to be formed and laid.

A still further object of the present invention is to provide an apparatus for laying a channel which enables the density of the degree of consolidation of the channel formed thereby to be adjusted freely depending on the kind of the paving material.

A further object of the present invention is to provide an apparatus for laying a channel or waterway having a mold part which can provide an excellent finish of the surface of the channel.

In accordance with the present invention, there is provided a paving material molding apparatus comprising a longitudinally and horizontally mounted frame means; a power generating means mounted on said frame means; a molding means mounted attachably and detachably on the lower surface of said frame means so that the paving material can be formed or molded in a predetermined sectional shape corresponding to that of said mold extending at right angles to the longitudinal axis thereof; a housing mounted in the front part of said molding means; said housing having a guide port including an open top part and connected to said molding means; a paving material transfer means including a plurality of screw conveyors mounted through said housing corresponding to the sectional area of the paving material to be laid; and a hopper means adapted to be registered with and mounted on the top-opening of said paving material transfer means, the arrangement being made such that the paving material supplied into the hopper means can be transferred by said screw conveyors into the molding means, the extrusion force of the screw conveyors increases the density of the paving material and the reaction force of the transfer of the screw conveyors can be used to propell the apparatus while the paving material is molded and laid on the ground surface.

BRIEF DESCRIPTION OF THE DRAWINGS

The above-mentioned and other objects of the present invention and advantages obtained thereby will be fully understood from the following detailed description taken in connection with the accompanying drawings, in which.

DETAILED DESCRIPTION OF THE PREFERRED EMBODIMENTS

Figure 1:
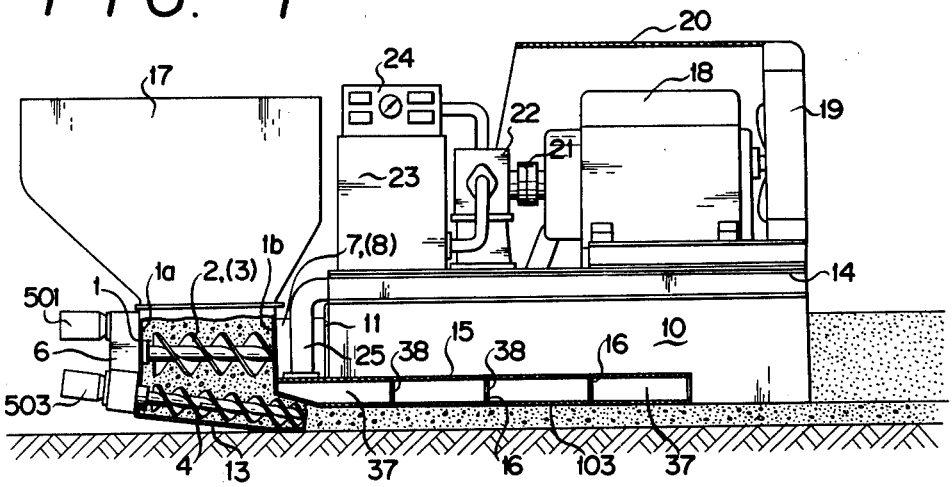
FIG. 1 is a front view of one embodiment of the present invention with a part thereof being broken away.
Figure 2:
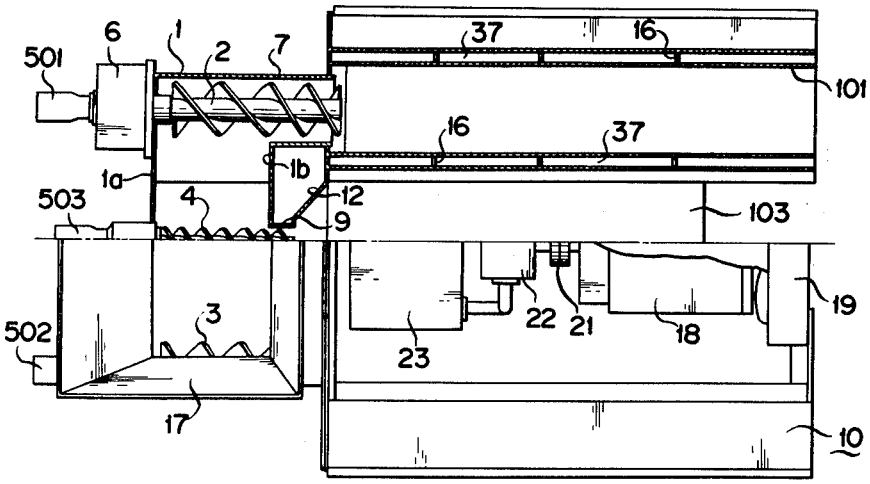
FIG. 2 is a plan view of the apparatus with a part being shown in section.

Referring to FIG. 1 showing the entire apparatus of the present invention schematically, reference numerals 2 and 3 indicate first and second screw conveyors of a large diameter for extrusion molding extending and fixedly secured on both sides of the bottom of a housing 1 in the direction of running, and reference numeral 4 denotes a small-diameter third screw conveyor for extrusion extending and fixedly secured in the direction of running.

One end of each of the extrusion screw conveyors 2, 3 and 4 is operatively connected through a reduction gear 6 to hydraulic motors 501, 502 and 503 fixedly secured, respectively, to front wall 1*a* of the housing 1, and the other end thereof extends, respectively, in cylindrical guide portion 7, 8 and 9 formed in rear wall 1*b* of the housing 1.

Further, extending in the direction of running and fixedly secured to the rear ends of the cylindrical guide portions 7, 8 and 9 through a mounting plate 11 is a mold 10, a large part of the lower surface of which is open and which has a section same as the section of a channel to be formed thereby. The embodiment of the present invention shown has a pair of first and second molds 101 annd 102 having angular shaped section and a third flat-plate shaped mold 103 connecting the first and second molds 101 and 102. The other ends of the aforementioned extrusion screw conveyors 2 annd 3 extend, respectively, in the leading ends of the first and second molds 101 and 102.

The third mold 103 is located higher than both side edges of the first and second molds 101 and 102 and is shorter than them in length in the direction of running, and is connected through an approximately semi-circle shaped connector member 12 to the central cylindrical guide portion 9.

Because of above-mentioned third screw conveyor 4 for extrusion being installed lower in level than the first and second screw conveyors, the third screw conveyor 4 is installed with an inclination angle so that it becomes gradually higher in level forwardly thereby eliminating any hindrance when running. The bottom wall of the housing 1 is similarly inclined, and a sliding plate 13 is fixedly secured on it so as to obtain easier sliding.

Mounted on the upper surface of frame members 14 are an engine 18 and a radiator 19 serving as a power unit, and a cover 20 for covering them is provided above them. Mounted further on the frame members 14 are a hydraulic pump 22, an oil tank 23 and a control means 24 therefor serving as a hydraulic pressure generating source. Further, the engine 18 and the hydraulic pump 21 are connected by means of a coupling 21.

Passages 37 are formed by stacking cover plates 15 of the same configuration as those of the first, second and third molds 101, 102 and 103 thereon through spacers 16 having exhaust holes 38, and an exhaust pipe 25 of the engine 18 is connected to the passages 37.

Figure 5:
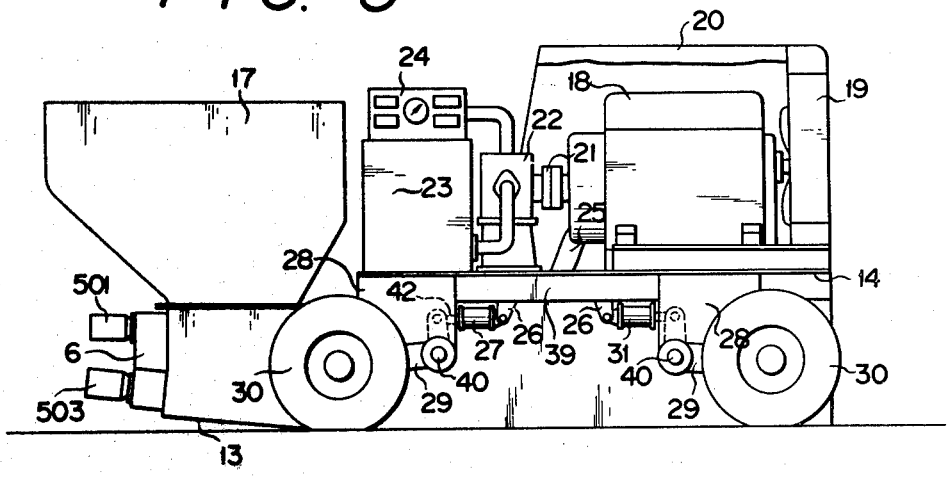
FIG. 5 is a front view of another embodiment of the present invention in which the apparatus of FIG. 1 is fitted with vertically freely movable wheels.

FIG. 5 shows another embodiment of the present invention in which the above-mentioned apparatus is provided with wheels for movement. The main components of the apparatus of the present invention will now be described below with reference to FIG. 5.

Fixedly secured to the frame member 14 are spacers 39 which have fixedly secured thereto brackets 28, 28 for mounting wheels 30, 30 and brackets 26, 26 for mounting the wheel raising and lowering cylinders.

Reference numeral 29 denotes an L-shaped crank having the wheels 30 mounted at one end thereof and a rod 42 of the wheel raising and lowering cylinder mounted at the other end thereof. The fulcrum of the crank 29 is supported through a pin 40 by the above-mentioned bracket 28 so that the wheels 30, 30 can be raised and lowered freely by means of a front wheel raising and lowering cylinder 27 and a rear wheel raising and lowering cylinder 31.

Figure 7:
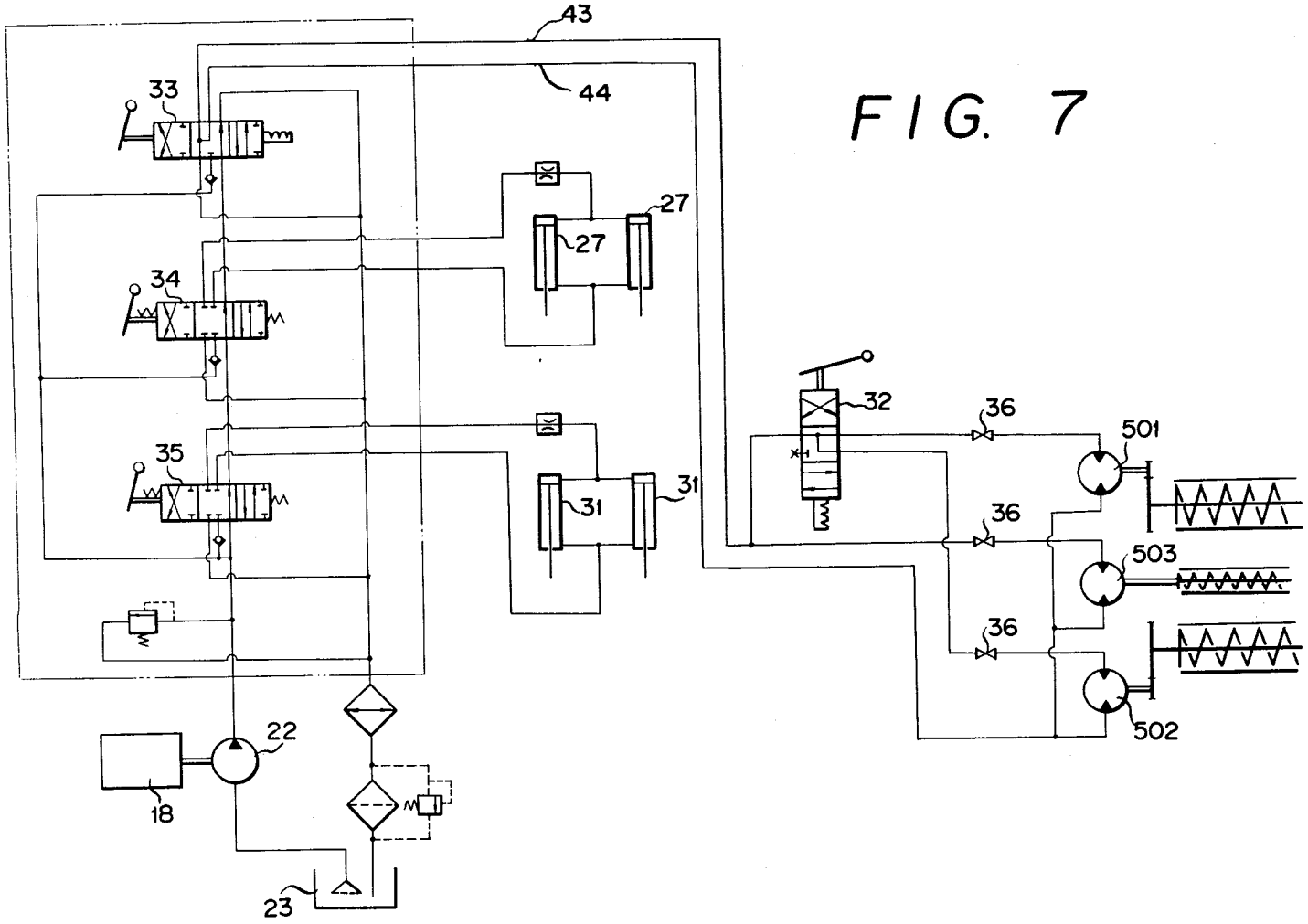
FIG. 7 shows a hydraulic circuit for use in the embodiment shown in FIG. 5.

FIG. 7 shows a hydraulic circuit for driving the apparatus of the present invention. The arrangement is made such that the fluid under pressure discharged by the hydraulic pump 22 driven by the engine 18 is selectively supplied in either forward rotation conduit 43 or reversing conduit 44 through a forward rotation and reversing changeover valve 33. Connected between the forward rotation conduit 43 and the reversing conduit 44 and through a steering valve 32 are hydraulic motor 501 for the first mold 101 and hydraulic motor 502 for the second mold 102 so that hydraulic motors 501, 502 and 503 are connected in parallel. Further, each of the hydraulic motors is provided with a manual stop valve 36 which can stop respective motor independently. The hydraulic motor 503 for the third mold 103 is adapted to drive the screw conveyor 4 directly, whilst the hydraulic motors 501 and 502 for the first and second molds are connected through reduction gears 6, 6 to the screw conveyors 2 and 3, respectively, thereby improving the torque.

On the other hand, the fluid under pressure discharged by the hydraulic pump 22 is supplied through change-over valves 34 and 35 for raising and lowering front and rear wheels into the front and rear wheel raising and lowering cylinders 27 and 31, respectively.

The operation of the above-mentioned apparatus according to the present invention will now be described hereinbelow.

When paving material is dumped into a hopper 17 and the hydraulic motors 501, 502 and 503 are driven, the paving material is conveyed by the first, second and third extrusion screw conveyors 2, 3 and 4 through the cylindrical guide portions 7, 8 and 9 to the first, second and third molds 101, 102 annd 103.

Consequently, the paving material is allowed to be consolidated or densely packed within the molds 101, 102 and 103, and when the paving material is conveyed further, the mold 10 is moved upwards so that the conveying pressure can move the whole apparatus in the direction indicated by an arrow "A".

Figure 4:
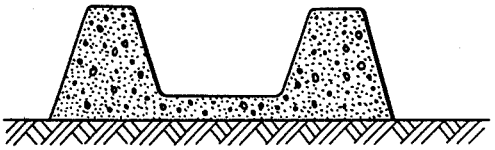
FIG. 4 shows the cross-section of a channel or waterway formed by the apparatus of the present invention.

By effecting the foregoing operation continuously, the whole apparatus can be moved continuously in the direction shown by the arrow "A" thereby enabling a channel or waterway having the same cross-sectional shape as that of the mold 10 to be formed continuously (Refer to FIG. 4).

At that time, the whole apparatus is guided or moved smoothly by means of a sliding plate 13.

Since the present invention is constructed as mentioned above, the extrusion force of the extrusion screw conveyors 2, 3 and 4 enables the paving material to be densely packed and formed in the same cross-sectional shape as that of the mold 10, and the reaction force of the extrusion force allows the entire apparatus to move or run.

However, in the case the paving material is a heated mixture of thermoplastic material (asphalt) and aggregates (conglomerate, sand, earth etc.), there occurs a problem that when the paving material is forced into the mold 10 the paving material kept in contact with the mold is cooled and solidified and sticks to the latter so that the mold cannot be slipped smoothly, as a result the channel formed thereby tends to form flaws on the surface thereof and so the external appearance thereof will become poor and a sufficient strength cannot be obtained in the channel, and further the flow resistance of water is increased.

Figure 3:
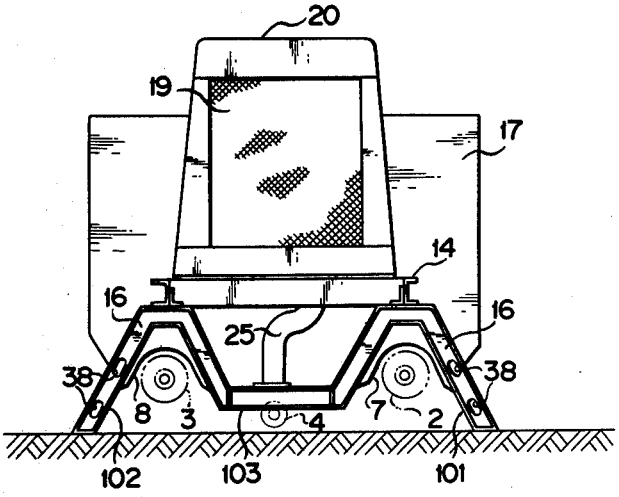
FIG. 3 is rear end view of the apparatus.

For this reason, according to the present invention, the mold 10 is constructed in a double-wall structure so as to form passages through which heated air is allowed to flow. Stating more specifically, as shown in FIGS. 1 and 3, cover plates 15 of the same shape as those of the molds 101, 102 and 103 are stacked or piled up on them through the spacers 16 so as to form passages 37 to which is connected the exhaust pipe 25 of the engine 18.

By such arrangement, the exhaust gas emitted by the engine 18 will flow out towards the side through the passages 37 so that the molds 101, 102 and 103 can be heated by it thereby preventing the paving material kept in contact with the molds from being cooled and solidified and sticking to them.

Accordingly, the surface on which the paving material is allowed to slip is always maintained in a smooth condition thereby eliminating formation of flaws in the channel formed thereby so that the external appearance thereof will not become poor, a sufficient strength can be maintained of the channel, and the flow resistance of water will not increase.

Figure 6:
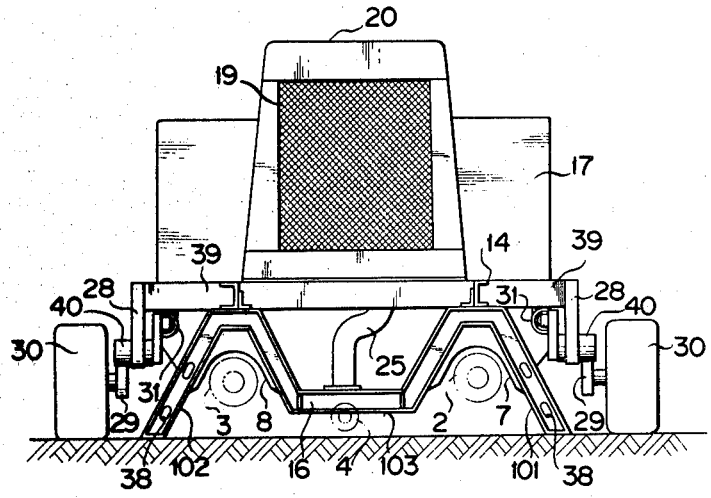
FIG. 6 is a rear end view of the apparatus of FIG. 5.

Further, another embodiment of the present invention in which the apparatus is provided with freely upwardly and downwardly movable wheels will now be described with reference to FIGS. 5 and 6. The apparatus of the present invention does not need any wheels in operation as mentioned above, and is adapted to propell by itself while laying channel. However, upon completion of the channel laying operation and when moving to another place, it becomes necessary to lift and move the apparatus by means of a crane etc. The example shown herein has been contemplated for solving such problem. In operation, the front and rear wheels 30, 30 are raised off the ground surface by the action of the front and rear wheel raising and lowering cylinders 27 and 31 through the L-shaped cranks 29. However, depending on the operational condition, only the front wheels may be lowered on the ground as a guide in operation. During the normal operation the rear wheels are raised off the ground surface and the load of the entire apparatus is applied on the mold portions thereby enabling the formation of a densely consolidated or packed channel or waterway. However, when it is necessary to adjust the density of the structural or paving material, it is needless to say that only the rear wheels may be lowered to some extent so that a part of the load of the entire apparatus can be supported by the rear wheels thereby adjusting the density of the paving material.

When the apparatus is not in operation, the wheels 30, 30 are lowered on the ground by means of the wheel raising and lowering cylinders 27 and 31 so that the entire apparatus can be supported by the wheels. By the above-mentioned arrangement, when moving the whole apparatus to a remote place, it can be propelled by rotating the wheels 30, 30.

Further, the apparatus of the present invention comprises a plurality of screw conveyors; however, there may occur the following problem when they are driven.

If unequal amounts of paving material are supplied into the first, second and third extrusion screw conveyors 2, 3 and 4, they tend to produce different extrusion forces, namely, different degrees of compaction or consolidation so that the channel formed thereby cannot be compacted uniformly and also the whole apparatus cannot be moved straight and will crawl meanderingly.

To eliminate such problem, the drive system for the extrusion screw conveyors of the apparatus of the present invention is constructed as shown in FIG. 7.

Stated more specifically, the arrangement is made such that the pressurized fluid discharged by the hydraulic pressure supply source 22 can be supplied selectively into either of the forward rotation conduit 43 or the reversing conduit 44 through the forward rotation and reversing change-over valve 33. Also the forward rotation conduit 43 and the reversing conduit 44 are connected, respectively, in parallel with the hydraulic motors 501, 502 and 503.

Reference numerals 22 and 23 indicate a stop valve and a tank for hydraulic fluid, respectively.

The above-mentioned arrangement enables the fluid pressures for driving the hydraulic motors 501, 502 and 503 to be kept equal.

However, when designing, the torque and speed reduction ratio of the hydraulic motors 501, 502 annd 503 and the pitches and diameters of the extrusion screw conveyors are required to be selected so that when the hydraulic motors are rotated by the same driving fluid pressure the average horizontal pressure applied to the side part of the channel formed thereby is equal to the average horizontal pressure applied to the bottom of the channel and a required pressure ratio is obtained between them.

By making the arrangement as shown in FIG. 7, when the paving material is not supplied into the first and second extrusion screw conveyors 2 and 3, the screw conveyors 2 and 3 will have no load and are idly rotated and the fluid pressure for driving the hydraulic motors 501 and 502 is lowered so that the fluid pressure for driving the hydraulic motor 503 associated with the third extrusion screw conveyor 4 connected in parallel therewith is lowered. As a result, even when the third extrusion screw conveyor 4 is supplied with paving materials, it cannot force the paving material into the mold 10 so that the whole apparatus is stopped and automatically waits until the paving material is supplied into the first and second extrusion screw conveyors 2 and 3.

While, since the pressurized fluid discharged by the hydraulic pressure supply source 22 is fed to the hydraulic motors 501 and 502 of the first and second extrusion screw conveyors 2 and 3, the number of rotations of the first and second screw conveyors 2 and 3 is increased. When the supply of the paving material is begun, the screw conveyors 2 and 3 will feed it at a high speed, and so the loading on the hydraulic motors 501 and 502 for the first and second extrusion screw conveyors is increased thereby increasing the fluid pressure for the first and second extrusion screw conveyors to the level for rotating the third extrusion screw conveyor 4 and enabling all the screw conveyors to be rotated at the same time.

Thus, any part of the channel formed by the apparatus is subjected to a required fluid pressure so that the channel can be compacted and formed at a predetermined density.

Further, by shutting off the stop valve 36, the hydraulic motor corresponding to it is stopped, and so only one or two of the first, second and third extrusion screw conveyors 2, 3 and 4 can be rotated.

Though not shown in the drawings, a reducing valve may be provided in the part connected to forward rotation conduits for the hydraulic motors 501, 502 and 503 so that the hydraulic pressure for driving the hydraulic motors can be altered or adjusted thereby enabling the density of the paving material within the mold to be adjusted properly.

Further, though not shown in the drawings, a paving material density adjusting means may be provided in which a weight is mounted in the space between the upper part of the third mold and the frame members so as to adjust the density of the material, or as an alternative a counterweight may be mounted on the rear end of the apparatus of the present invention.

In the embodiments of FIGS. 1 annd 5, the sliding plate 13 is formed at the bottom of the housing 1 as an integral part thereof, however, this sliding plate may be omitted and instead a short sliding plate may be mounted to the front bottom part of the housing 1 so as to make the housing 1 having no bottom wall. Thus in this modification, paving material dumped in the hopper 17 directly touches to or deposited on the bare ground and therefore part of the paving material is forced into the mold 10 by the action of the screw conveyors while the another part of the paving material deposited on the bare ground under the screw conveyors is introduced into the mold 10 without using the action of the screw conveyors as the entire apparatus moves or proceeds by the reaction force of the extrusion force of the screw conveyors. Therefore total amount of the paving material introduced into the mold 10 is increased when compared with the embodiments having the bottom sliding plate 13 shown in FIGS. 1 and 5 thus improving the speed of the paving.

Although not specifically shown in the drawings the hopper 17 can equip a screw conveyor arranged parallel to the ground and vertical to the proceeding direction of the machine. The screw conveyor in the hopper can be engaged with the hopper 4 so as to be driven thereby. Therefore should bridges of the paving material be formed in the hopper 17, they may be broken by the action of the screw conveyor.

Since the apparatus of the present invention is constructed as mentioned hereinabove, the paving material can be compacted and molded in the same sectional shape as that of the mold 10 by the extrusion force of the extrusion screw conveyors, and the whole apparatus can be propelled or moved by the reaction force of the extrusion force.

It is to be understood that the foregoing description is merely illustrative of the preferred embodiments of the invention and that the scope of the invention is not be be limited thereto, but is to be determined by the scope of the appended claims.

What we claim is:

1. A paving material extrusion molding apparatus, comprising longitudinally and horizontally mounted frame means; power generating means mounted on said frame means, molding means detachably mounted on the lower surface of said frame means so that the paving material can be formed or molded in a predetermined cross-sectional shape corresponding to that of said molding means extending at right angles to the longitudinal axis thereof; a housing mounted on the front part of said molding means, said housing having a guide port and a top opening, said housing being connected to said molding means; paving material transfer means including a plurality of screw conveyors mounted in said housing; and hopper means adapted to be registered with and mounted on the top opening of said housing wherein the paving material supplied into the hopper means flows into said housing and is transferred by said screw conveyors into the molding means, wherein the combination of the weight of the apparatus with the extrusion force of the screw conveyors serves to increase the density of the paving material, and wherein the reaction force of the transfer of the screw conveyors can be used to propel the apparatus while the paving material is molded and laid on the ground surface.

2. A paving material molding apparatus as defined in claim 1, wherein the port connections to the molding means and said transfer means is formed so as to surround the part of the external parts of said plurality of screw conveyors thereby increasing the paving material transfer efficiency.

3. A paving material molding apparatus as defined in claim 1, wherein said molding means has a double-wall construction, and the heat of exhaust gas emitted by an internal combustion engine serving as a power generating means is introduced into said molding means thereby preventing the adhesion or sticking of the paving material to the inner surface of said molding means.

4. A paving material molding means as defined in claim 3, wherein baffle plates or partitions are provided so that said heat of the exhaust gas can be introduced into the central front part of said molding means and is allowed to flow around the inside of the molding means and flow out towards the rear part of the apparatus.

5. A paving material molding means as defined in claim 1, wherein said power generating means is arranged to produce pressurized fluid by a hydraulic pump driven by an internal combustion engine, the pressurized fluid acting to drive or rotate said screw conveyors.

6. A paving material holding apparatus as defined in claim 1, wherein said transfer means has a forwardly raised or inclined bottom thereby improving the flow of the paving material within the housing.

7. A paving material molding apparatus as defined in claim 1, wherein the screw conveyors of said transfer means are or rotated by means of respective hydraulic motors, all of said screw conveyors being arranged to be driven or rotated to produce an equal extrusion force per square centimeter regardless of the transfer capacity of the screw conveyors.

8. A paving material molding apparatus as defined in claim 1, including hydraulic circuit means for controlling said screw conveyors wherein when any one of the plurality of screw conveyors of said transfer means is rotated below a rated torque or idly rotated without bearing load, other screw conveyors stop their rotation so that the paving material cannot be transferred, thereby stopping the movement of the apparatus and preventing the density of the paving material from becoming too coarse so as to prevent formation of blowholes inside.

9. A paving material molding apparatus as defined in claim 1, including a member extending to the side of the frame means, said member having an auxiliary wheel connected to one end of a linkage, a hydraulic cylinder connected to the other end of said linkage, said auxiliary wheel being adapted to be moved upwards and downwards by means of said hydraulic cylinder, whereby the height of the frame means above the ground surface is controlled so that the density of the molded article can be adjusted depending on the nature of the paving material and the apparatus can be easily moved by traction.

10. A paving material molding apparatus as defined in claim 1, wherein said housing has an open bottom wall allowing the paving material to directly touch the ground surface, said housing including a sliding plate mounted to the front part thereof whereby the paving material between the screw conveyors and the ground can be introduced into said molding means without being pushed by the screw conveyors.

11. A paving material molding apparatus as defined in claim 1 further comprising another screw conveyor mounted in said hopper means.

* * * * *